US006835418B2

(12) United States Patent
Capizzi

(10) Patent No.: US 6,835,418 B2
(45) **Date of Patent: *Dec. 28, 2004**

(54) USE OF GASEOUS STREAMS TO AID IN APPLICATION OF FOAM TO TISSUE PRODUCTS

(75) Inventor: Joseph G. Capizzi, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 159 days.

This patent is subject to a terminal disclaimer.

(21) Appl. No.: 10/161,049

(22) Filed: May 31, 2002

(65) Prior Publication Data

US 2003/0224106 A1 Dec. 4, 2003

(51) Int. Cl.[7] ..... B05D 3/00; B05D 3/04

(52) U.S. Cl. ..... 427/296; 427/348; 427/356; 427/358; 427/421; 427/424; 427/243

(58) Field of Search ..... 427/243, 348, 427/356, 358, 421, 424, 296

(56) References Cited

U.S. PATENT DOCUMENTS

| | | | |
|---|---|---|---|
| 3,722,469 | A | 3/1973 | Bartley et al. |
| 3,865,078 | A | 2/1975 | De Howitt et al. |
| 3,905,329 | A | 9/1975 | Cone et al. |
| 3,930,465 | A | 1/1976 | Schuierer |
| 4,005,028 | A | 1/1977 | Heckert |

(List continued on next page.)

FOREIGN PATENT DOCUMENTS

| | | |
|---|---|---|
| DE | 252208 | 10/1911 |
| EP | 0047908 | 3/1982 |
| EP | 0098362 | 1/1984 |
| EP | 0120472 | 10/1984 |
| EP | 0195458 A1 | 9/1986 |
| EP | 0196576 | 4/1989 |
| EP | 0336439 | 10/1989 |
| EP | 1149947 | 10/2001 |
| GB | 1585874 | 3/1981 |
| WO | WO 9840207 A1 | 9/1998 |
| WO | WO 9913158 | 3/1999 |
| WO | WO 9919081 | 4/1999 |
| WO | WO 0015907 A1 | 3/2000 |
| WO | WO 0216689 A3 | 2/2002 |
| WO | WO 0216689 A2 | 2/2002 |
| WO | WO 0238865 A2 | 5/2002 |
| WO | WO 0238865 A3 | 6/2002 |

OTHER PUBLICATIONS

U.S. patent application Ser. No. 10/007,627, Capizzi, filed Nov. 8, 2001, Foam Treatment of Tissue Products.

U.S. patent application Ser. No. 10/161,047, Capizzi, filed May 31, 2002, Method of Applying a Foam Composition to a Tissue Products.

U.S. patent application Ser. No. 10/161,048, Capizzi, filed May 31, 2002, Application of Foam to Tissue Products Using a Liquid Permeable Partition.

Recent Developments in Foam Application Systems.

*Primary Examiner*—Katherine Bareford
(74) *Attorney, Agent, or Firm*—Dority & Manning, P.A.

(57) ABSTRACT

A method for applying a foam composition to a paper web is provided. Specifically, a foam applicator is positioned adjacent to a surface of the web. The foam applicator comprises an extrusion head defining an extrusion channel through which the foam composition is capable of flowing. The foam applicator further defines a dispensing slot through which the foam composition is capable of exiting the foam applicator. The method also includes flowing the foam composition through the extrusion channel of the foam applicator. The foam composition is impinged with at least one gaseous stream (e.g., air stream) to fragment or break up gaseous bubbles contained therein.

20 Claims, 6 Drawing Sheets

U.S. PATENT DOCUMENTS 4,005,030 A 1/1977 Heckert
4,016,831 A 4/1977 James et al.
4,023,526 A 5/1977 Ashmus et al.
4,061,001 A 12/1977 Von der Eltz et al.
4,081,318 A 3/1978 Wietsma
4,089,296 A 5/1978 Barchi
4,099,913 A 7/1978 Walter et al.
4,118,526 A 10/1978 Gregorian et al.
4,158,076 A 6/1979 Wallsten
4,159,355 A 6/1979 Kaufman
4,184,914 A 1/1980 Jenkins
4,193,762 A 3/1980 Namboodri
4,198,316 A 4/1980 Nahta
4,230,746 A 10/1980 Nahta
4,237,818 A 12/1980 Clifford et al.
4,263,344 A 4/1981 Radvan et al.
4,276,339 A 6/1981 Stoveken
4,279,964 A 7/1981 Heller
4,288,475 A 9/1981 Meeker
4,297,860 A 11/1981 Pacifici et al.
4,305,169 A 12/1981 Vidalis
4,343,835 A 8/1982 Jones et al.
4,348,251 A 9/1982 Pauls et al.
4,364,784 A 12/1982 Van Wersch et al.
4,366,682 A 1/1983 Keller
4,384,867 A 5/1983 Grüber
4,385,954 A 5/1983 Pauls et al.
4,387,118 A 6/1983 Shelton
4,400,953 A 8/1983 Driessen et al.
4,402,200 A 9/1983 Clifford et al.
4,435,965 A 3/1984 Sasseville et al.
4,440,808 A 4/1984 Mitter
4,442,771 A 4/1984 Mitter
4,444,104 A 4/1984 Mitter
4,453,462 A 6/1984 Mitter
4,463,467 A 8/1984 Grüber et al.
4,463,583 A 8/1984 Krüger et al.
4,474,110 A 10/1984 Rosner
4,497,273 A 2/1985 Mitter
4,498,318 A 2/1985 Mitter
4,501,038 A 2/1985 Otting
4,502,304 A 3/1985 Hopkins
4,534,189 A 8/1985 Clifford
4,549,915 A * 10/1985 Ritschel et al. ..... 156/78
4,552,778 A 11/1985 Zimmer
4,557,218 A 12/1985 Sievers
4,559,243 A 12/1985 Pässler et al.
4,562,097 A 12/1985 Walter et al.
4,571,360 A 2/1986 Brown et al.
4,576,112 A 3/1986 Funger et al.
4,581,254 A 4/1986 Cunningham et al.
4,597,831 A 7/1986 Anderson
4,606,944 A * 8/1986 Lauchenauer ..... 427/296
4,612,874 A 9/1986 Mitter
4,646,675 A 3/1987 Arthur et al.
4,655,056 A 4/1987 Zeiffer
4,665,723 A 5/1987 Zimmer
4,667,882 A 5/1987 Pacifici
4,731,092 A 3/1988 Berendt
4,734,100 A 3/1988 Berendt et al.
4,741,739 A 5/1988 Berendt et al.
4,762,727 A 8/1988 Voswinckel
4,773,110 A 9/1988 Hopkins
4,778,477 A 10/1988 Lauchenauer
4,792,619 A 12/1988 Berendt et al.
4,799,278 A 1/1989 Beeh
4,833,748 A 5/1989 Zimmer et al.
4,872,325 A 10/1989 Moser et al.
4,894,118 A 1/1990 Edwards et al.
4,912,948 A 4/1990 Brown et al.
5,008,131 A 4/1991 Bakhshi
5,009,932 A 4/1991 Klett et al.
5,048,589 A 9/1991 Cook et al.
5,089,296 A 2/1992 Bafford et al.
5,145,527 A 9/1992 Clifford et al.
5,165,261 A 11/1992 Cho
5,219,620 A 6/1993 Potter et al.
5,227,023 A 7/1993 Pounder et al.
5,328,685 A 7/1994 Janchitraponvej et al.
5,340,609 A 8/1994 Arthur et al.
5,366,161 A 11/1994 Potter et al.
5,399,412 A 3/1995 Sudall et al.
5,429,840 A * 7/1995 Raterman et al. ..... 427/256
5,492,655 A 2/1996 Morton et al.
5,505,997 A 4/1996 Strong et al.
5,510,001 A 4/1996 Hermans et al.
5,524,828 A 6/1996 Raterman et al.
5,552,020 A 9/1996 Smith et al.
5,591,309 A 1/1997 Rugowski et al.
5,605,719 A 2/1997 Tench et al.
5,635,469 A 6/1997 Fowler et al.
5,667,636 A 9/1997 Engel et al.
5,783,043 A 7/1998 Christensen
5,792,737 A 8/1998 Grüning et al.
5,795,386 A 8/1998 Foster et al.
5,830,483 A 11/1998 Seidel et al.
5,840,403 A 11/1998 Trokhan et al.
5,857,627 A 1/1999 Horwell et al.
5,861,143 A 1/1999 Peterson et al.
5,869,075 A 2/1999 Krzysik
5,904,809 A 5/1999 Rokman et al.
5,985,434 A 11/1999 Qin et al.
6,017,417 A 1/2000 Wendt et al.
6,103,128 A 8/2000 Koso et al.
6,132,803 A 10/2000 Kelly et al.
6,238,518 B1 5/2001 Rokman et al.
6,241,220 B1 6/2001 Blackwell et al.
6,582,555 B2 6/2003 Capizzi et al.
6,612,468 B2 9/2003 Pritchett et al.

* cited by examiner

USE OF GASEOUS STREAMS TO AID IN APPLICATION OF FOAM TO TISSUE PRODUCTS

BACKGROUND OF THE INVENTION

Consumers use tissue products for a wide variety of applications. For example, various types of tissue products may be used, such as facial tissues, bath tissues, paper towels, napkins, wipes, etc. In many instances, various types of liquid-based compositions, such as softening compositions, lotions, friction reducing agents, adhesives, strength agents, etc., are also applied to one or paper webs of the tissue product. For example, a paper web is often softened through the application of a chemical additive (i.e., softener). However, one problem associated with some liquid-based compositions is the relative difficulty in uniformly applying the composition to the paper web of the tissue product. Moreover, many application methods are relatively inefficient and thus may result in substantial waste of the composition being applied.

For instance, many softeners are made as an emulsion containing a particular solids content in solution. However, such liquid-based compositions are often difficult to adequately apply to a paper web. In particular, when applying such a liquid-based composition, the paper web can become undesirably saturated, thereby requiring the paper web to be dried. Moreover, it is also difficult to uniformly spread the liquid-based composition on a paper web in such a manner to provide adequate surface area coverage. In addition, some softeners contain components that cause the liquid-based composition to be formed as a solid or semi-solid. To facilitate application of these liquid-based compositions onto a tissue product, extensive heating may be required. Moreover, even after extensive heating, it may nevertheless be difficult to uniformly apply the composition to the tissue surface.

As such, a need currently exists for an improved method of applying a liquid-based composition to a paper web.

SUMMARY OF THE INVENTION

In accordance with one embodiment of the present invention, a method of applying a foam composition to a paper web (wet or dry) having a first surface and an opposing second surface is disclosed. The method comprises positioning a foam applicator adjacent to the first surface of the web. The foam applicator defines an extrusion channel through which the foam composition is capable of flowing. The foam applicator further defines a dispensing slot through which the foam composition is capable of exiting the foam applicator. In one embodiment, the foam applicator further defines a gaseous channel through which the gaseous stream is capable of flowing. When flowing through the gaseous channel, the gaseous stream can be accelerated therethrough.

The method also includes flowing the foam composition through the extrusion channel of the foam applicator. The flowing foam composition is impinged with at least one gaseous stream (e.g., air stream) to fragment gaseous bubbles contained therein before the foam composition is applied to the first surface of the paper web.

Depending on the type of foam applicator selected, the foam composition can be impinged with the gaseous stream before (internal) or after (external) exiting the dispensing slot. Moreover, regardless of the specific type of foam applicator selected, various geometric and/or process parameters may be controlled in the present invention. For example, in one embodiment, the distance from the initial convergence of the gaseous stream to the dispensing slot is from about 0.1 to about 12 inches, and in some embodiments, from about 0.2 to about 10 inches. Moreover, in some instances, the angle at which the gaseous stream impinges the foam composition is from 5° to about 60°, and in some embodiments, from about 10° to about 40°.

In addition, the method described above can also further comprise positioning a vacuum slot adjacent to the second surface of the paper web so that the paper web is positioned between the foam applicator and the vacuum slot. Such a vacuum slot can help draw the foam composition onto the first surface of the paper web.

In accordance with another embodiment of the present invention, a foam applicator system for applying foam to a paper web is disclosed. The system comprises a foam applicator that comprises an extrusion head defining an extrusion channel through which a foam composition is capable of flowing and an air channel through which an air stream is capable of flowing. The foam applicator further defines a dispensing slot through which the foam composition is capable of exiting the foam applicator. In one embodiment, the air channel and extrusion channel intersect within the extrusion head so that the air stream is capable of impinging the foam composition before the foam composition exits the dispensing slot. In another embodiment, the air channel and extrusion channel are configured such that the air stream impinges the foam composition only after the foam composition exits the dispensing slot.

Other features and aspects of the present invention are described in more detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
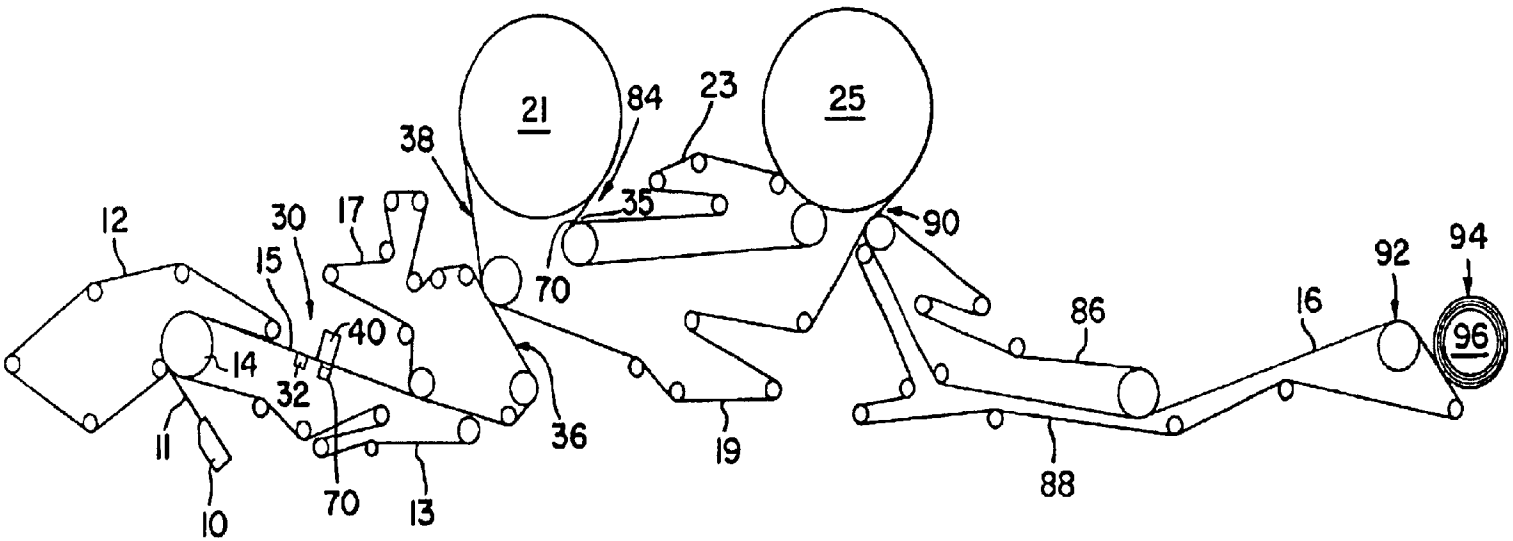
FIG. 1 is a schematic flow diagram of one embodiment of the present invention for forming a paper web.

Repeat use of reference characters in the present specification and drawings is intended to represent same or analogous features or elements of the present invention.

DETAILED DESCRIPTION OF REPRESENTATIVE EMBODIMENTS

Definitions

As used herein, the terms "foam" or "foam composition" generally refer to a porous matrix that is an aggregate of hollow cells or bubbles, the walls of which contain liquid material. The cells may be interconnected to form channels or capillaries within the foam structure wherein such channels or capillaries facilitate liquid distribution within the foam.

As used herein, the terms "liquid composition" or "liquid-based composition" generally refer to any composition that is capable of existing in a liquid state. In particular, a liquid-based composition may exist naturally in a liquid state, or may require liquid-enhancing aids, such as heating or cooling, foaming aids (e.g., surfactants), viscosity modifiers, etc., to achieve such a liquid state. Moreover, a "liquid-based" composition can also include emulsions having a certain solids content. Some examples of liquid-based compositions that may be applied to a paper web may include, but are not limited to, softening agents, wet-strength agents, binders, adhesives, friction-reducing agents, and other compositions often applied during a papermaking process.

Other materials may also be utilized in conjunction with the liquid-based composition. For example, a variety of foaming aids may be applied to the liquid-based composition. Foaming aids may be useful in facilitating the generation of foam. A foaming aid may also be useful in stabilizing existing foam. In general, any of a variety of foaming aids may be applied to the liquid-based composition. In particular, foaming aids that have a low critical miscelle concentration, are cationic and/or amphoteric, and have small bubble sizes are typically utilized. Some examples of suitable foaming aids include, but are not limited to, fatty acid amines, amides, and/or amine oxides; fatty acid quaternary compounds; electrolytes (to help achieve foam stability); and the like. Some commercially available foaming aids that are suitable in the present invention are Mackernium 516, Mackam 2C, and Mackam CBS-50G made by McIntyre Group, Ltd. When utilized, the foaming aids can sometimes be incorporated into the liquid-based composition in amounts up to about 100% by weight of the liquid-based composition, in some embodiments from about 0.1 to about 20% by weight of the liquid-based composition, and in some embodiments, from about 2% by weight to about 5% by weight. Other suitable foaming aids are described in U.S. Pat. No. 4,581,254 issued to Cunningham, et al., which is incorporated herein in its entirety by reference thereto for all purposes (hereinafter referred to as the "Cunningham et al. reference").

Still other examples of suitable materials that may be added to a liquid-based composition are disclosed in U.S. Pat. No. 5,869,075 issued to Krzysik, which is incorporated herein in its entirety by reference for all purposes. For instance, some of such materials include, but are not limited to: anti-microbial agents; odor absorbers; masking fragrances; antiseptic actives; anti-oxidants; astringents—cosmetic (induce a tightening or tingling sensation on skin); astringent—drug (a drug product which checks oozing, discharge, or bleeding when applied to skin or mucous membrane and works by coagulating protein); biological additives (enhance the performance or consumer appeal of the product); colorants (impart color to the product); emollients (help to maintain the soft, smooth, and pliable appearance of the skin by their ability to remain on the skin surface or in the stratum corneum to act as lubricants, to reduce flaking, and to improve the skin's appearance); external analgesics (a topically applied drug that has a topical analgesic, anesthetic, or antipruritic effect by depressing cutaneous sensory receptors, of that has a topical counter-irritant effect by stimulating cutaneous sensory receptors); film formers (to hold active ingredients on the skin by producing a continuous film on skin upon drying); humectants (increase the water content of the top layers of the skin); natural moisturizing agents (NMF) and other skin moisturizing ingredients known in the art; opacifiers (reduce the clarity or transparent appearance of the product); skin conditioning agents; skin exfoliating agents (ingredients that increase the rate of skin cell turnover such as alpha hydroxy acids and beta hydroxyacids); skin protectants (a drug product which protects injured or exposed skin or mucous membrane surface from harmful or annoying stimuli); and the like.

As used herein, a "tissue product" generally refers to various paper-based products, such as facial tissue, bath tissue, paper towels, napkins, and the like. Normally, the basis weight of a tissue product of the present invention is less than about 120 grams per square meter (gsm), in some embodiments less than about 80 grams per square meter, and in some embodiments, from about 10 to about 60 gsm.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to a method for applying a liquid-based foam composition to a paper web of a tissue product. Prior to application, the liquid-based composition is contacted with a gaseous stream (e.g., air stream) to fragment or break up gaseous bubbles contained within the composition, thereby promoting a more controllable and uniform application to the paper web.

A liquid-based composition may be formed into a foam composition according to any foam-forming technique known in the art. For instance, in one embodiment, a liquid-based composition may be metered to a foaming system where it may be combined with a gas, such as compressed air, in various proportions. For example, to ensure that the resulting foam is generally stable, the ratio of air volume to liquid volume in the foam (i.e., blow ratio) may be greater than about 3:1, in some embodiments from about 5:1 to about 180:1, in some embodiments from about 10:1 to about 100:1, and in some embodiments, from about 20:1 to about 60:1. For instance, in one embodiment, a blow ratio of about 30:1 may be obtained from a liquid flow rate of 113 cubic centimeters per minute and an air flow rate of 3400 cubic centimeters per minute. In another embodiment, a blow ratio of about 20:1 may be obtained from a liquid flow rate of 240 cubic centimeters per minute and an air flow rate of 4800 cubic centimeters per minute.

Within the foaming system, a foam generator may combine the air and the liquid-based composition at a certain energy so that a foam may form. In one embodiment, for example, the foam generator rotates at a certain speed so as to cause the liquid-based composition to pass through a series of edges, which allow trailing eddy currents of air to entrain into the liquid-based composition. In particular, the foam generator may operate at speeds from about 300 revolutions per minute (rpm) to about 700 rpm, and more particularly from about 400 rpm to about 600 rpm. For example, suitable foam generators are described in U.S. Pat. No. 4,237,818 issued to Clifford et al., which is incorporated herein in its entirety by reference thereto for all purposes (hereinafter referred to at the "Clifford et al. reference"). Moreover, one commercially available foam generator that may be utilized in the present invention may be obtained from Gaston Systems, located in Stanley, N.C.

The characteristics of the resulting foam may vary, depending on the parameters of the foam generator utilized, the ratio of the volume of gas to the volume of the liquid-based composition, etc. For instance, in some embodiments, the foam may have a "half-life" that allows the foam to travel from the foam generator to an applicator before collapsing. In some embodiments, a foam bubble may have a half-life of greater than about 1 minute, in some embodiments greater than about 3 minutes, in some embodiments from about 3 minutes to about 30 minutes, and in some embodiments, from about 15 minutes to about 25 minutes.

The half-life of the foam may generally be determined in the following manner. A calibrated beaker is positioned on a scale and placed under a 500 cubic centimeter separator funnel. Approximately 50 grams of a foam sample is then collected into the separator funnel. As soon as all of the foam is placed in the funnel, a standard stopwatch is started. When approximately 25 grams of liquid collects into the calibrated beaker, the time is stopped and recorded. This recorded time is the foam half-life.

In some instances, the average cell size, wall thickness, and/or density may also foster the stability of the foam. For instance, the foam may have a size, thickness, or density such as described in U.S. Pat. No. 4,099,913 issued to Walter, et al. and U.S. Pat. No. 5,985,434 issued to Qin, et al., which are both incorporated herein in their entirety by reference thereto for all purposes. For example, in one embodiment, the average cell size of the foam cell may be from about 10 microns to about 1100 microns. Moreover, the average wall thickness of the foam cell may be from about 0.1 micron to about 30 microns.

After generation, the foam is then forced out of the foam generator, where it may travel via one or more conduits to a foam applicator to be applied to a paper web. The diameter of the conduits, the length of the conduits, the pressure of the foam bubbles after exiting the foam generator, and the like, may all be controlled to vary the nature of foam application. For instance, in one embodiment, a conduit having an inner diameter from about 0.375 inches to about 1.5 inches may be utilized to process from about 10 to about 3000 cubic centimeters of air per minute, such as from about 300 to about 3000 cubic centimeters of air per minute and about 20 to about 300 grams of liquid per minute. Moreover, in one embodiment, the length of the conduit may be about 50 feet in length. In addition, upon exiting the foam generator, the pressure of the foam bubbles may be from about 5 psi to about 90 psi, and more particularly from about 30 psi to about 60 psi.

As stated, once the foam exits the foam generator, it may then be supplied to a foam applicator. In general, any foam applicator that is capable of applying a foam, such as described above, onto a paper web may be used in the present invention. In some embodiments, when applied to a relatively wet paper web, it may be desired that the foam applicator be capable of applying foam without substantially contacting the surface of the paper web during foam application. For instance, in some instances, the foam applicator may be positioned less than about 2 inches from the surface of the paper web, and in some instances, from about 1 inch to about 2 inches from the surface of the paper web. In one embodiment, for example, the foam applicator is positioned about 1.375 inches from the surface of the paper web. In another embodiment, the foam applicator is positioned about 1 inch from the surface of the paper web.

In situations where the chemical add-on of the liquid-based composition is not excessive, such as less than about 30% of the basis weight of the dried paper web 16 (See FIG. 1) and in some embodiments, less than about 10% of the basis weight of the dried paper web 16, the application of the foam using standard foam applicators may have a tendency to contact, thereby coating, only a portion of the higher points, including such areas as the ridges or protuberances, in the surface of the wet paper web 15. This can result in little or no chemical treatment of the composition reaching the low points, including such areas as the valleys or recesses, in the surface of the wet paper web 15.

Thus, in accordance with the present invention, the foam applicator is configured such that the foam composition is contacted with a gaseous stream. Although not limited in theory, it is believed that the gaseous bubbles still present within the foam composition are fragmented or broken up when impinged with the gaseous stream. This fragmentation of the gaseous bubbles allows for the formation of particles of the desired composition that can be uniformly applied to the higher and/or lower points of a paper web.

Figure 2:
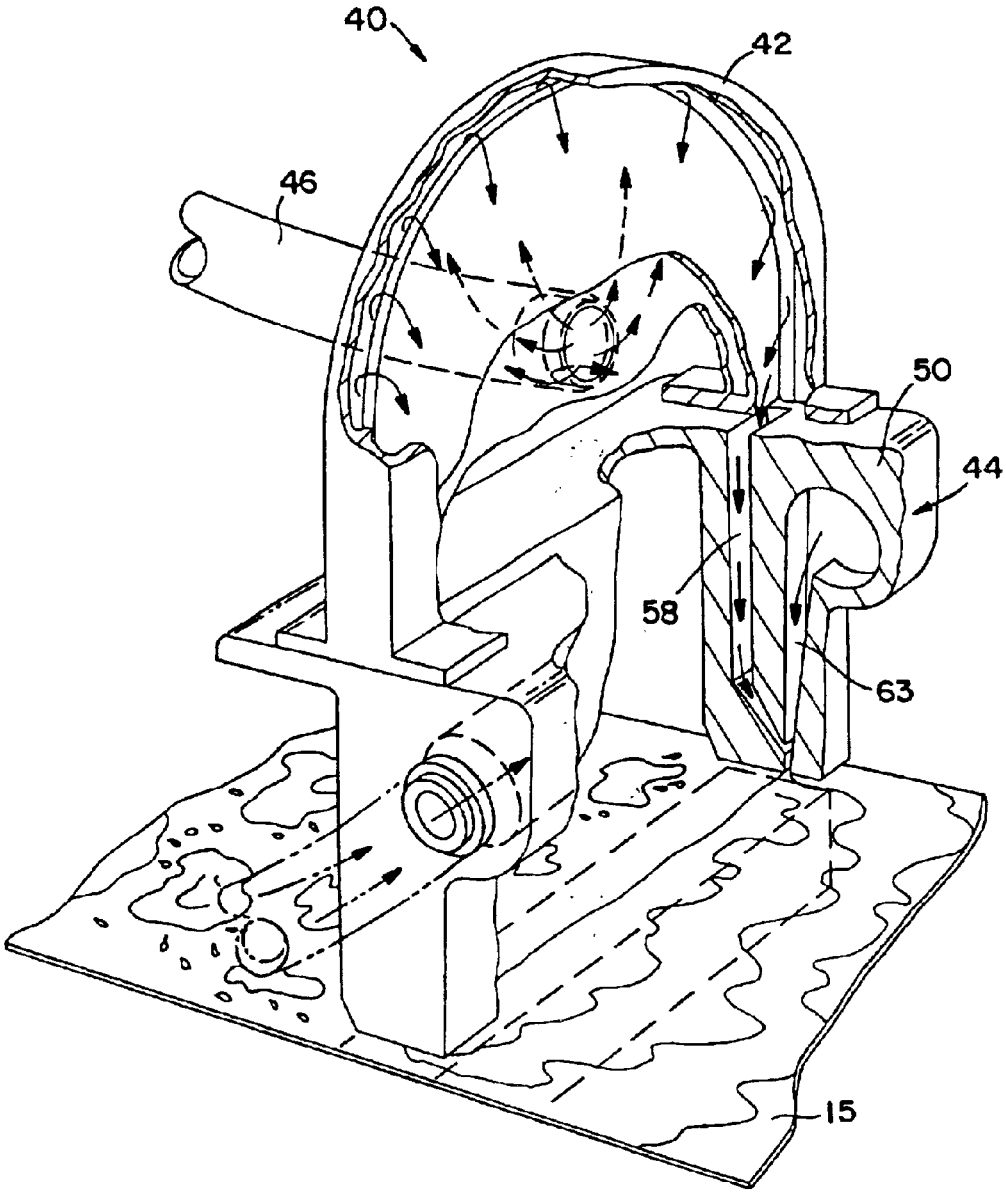
FIG. 2 is a perspective view of one embodiment of a foam applicator that may be used to apply foam to a paper web in the present invention.

To accomplish the fragmentation of the gaseous bubbles, the foam composition can be impinged with a gaseous stream internally and/or externally to the foam applicator. For example, referring to FIGS. 2–3, one embodiment of a foam applicator 40 capable of internally contacting a foam composition with a stream of air is illustrated. As depicted, the foam applicator 40 includes a distribution chamber 42 and an extrusion head 44. The distribution chamber 42 may generally have any desired shape, size, and/or dimension. For instance, the distribution chamber 42 shown in FIG. 2 has a parabolic shape. Other examples of suitable distribution chambers are described in the Clifford et al. reference. Moreover, it should also be understood that any method or apparatus for applying a foam to a paper web may be used in the present invention, and that the foam applicator 40 depicted and described herein is for illustrative purposes only.

As the foam enters the distribution chamber 42 from a conduit 46, it is initially forced upward to assure that any decaying foam collects therein for automatic draining. Thereafter, it is forced downward, as indicated by the arrows in FIG. 2, through the distribution chamber 42 to the extrusion head 44. In general, extrusion heads having any of a variety of shapes and sizes may be used in the present invention. In one embodiment of the present invention, a "straight slot" extrusion head, such as described in the Clifford, et al. reference and the Cunningham, et al. reference, is utilized. As used herein, the straight slot extrusion head generally refers to an extrusion head generally 44 having parallel nozzle bars 48 and 50. In one embodiment, the extrusion head 44 includes two parallel nozzle bars, a first nozzle bar 48 and a second nozzle bar 50, that form a dispensing slot 52 which generally has a width of from about 0.025 inches to about 0.5625 inches in the -x direction (machine direction), and in some embodiments, from about 0.050 inches to about 0.0626 inches. For instance, in one embodiment, the width of the dispensing slot 52 in the -x direction is about 0.13 inches. In another embodiment, the width of the dispensing slot 52 in the -x direction is about 0.05 inches. Moreover, the length of the dispensing slot 52 in the -z direction (cross direction) can vary depending on the dimensions of the web. For instance, in some embodiments, the dispensing slot 52 has a length from about 0.125 inches to about 300 inches in the -z direction (cross direction). The length of the dispensing slot 52, however, may be varied as desired to adjust the paper web handling land area. For example, in some embodiments, the length of the dispensing slot 52 in the -z direction is from about 100 inches to about 200 inches.

Further, as shown, the foam composition enters the extrusion head 44 via an extrusion channel 58 and traverses therethrough toward the paper web 15. In this particular embodiment, the extrusion channel 58 bends at a point 59 toward an air stream 61 that is traveling internally within the extrusion head 44 through an air channel 63. The air stream 61 is provided by a supply manifold that supplies the air for acceleration through the air channel 63. Upon contact with the foam composition, the air stream 61 impinges the foam composition to fragment the gaseous bubbles.

Figure 4:
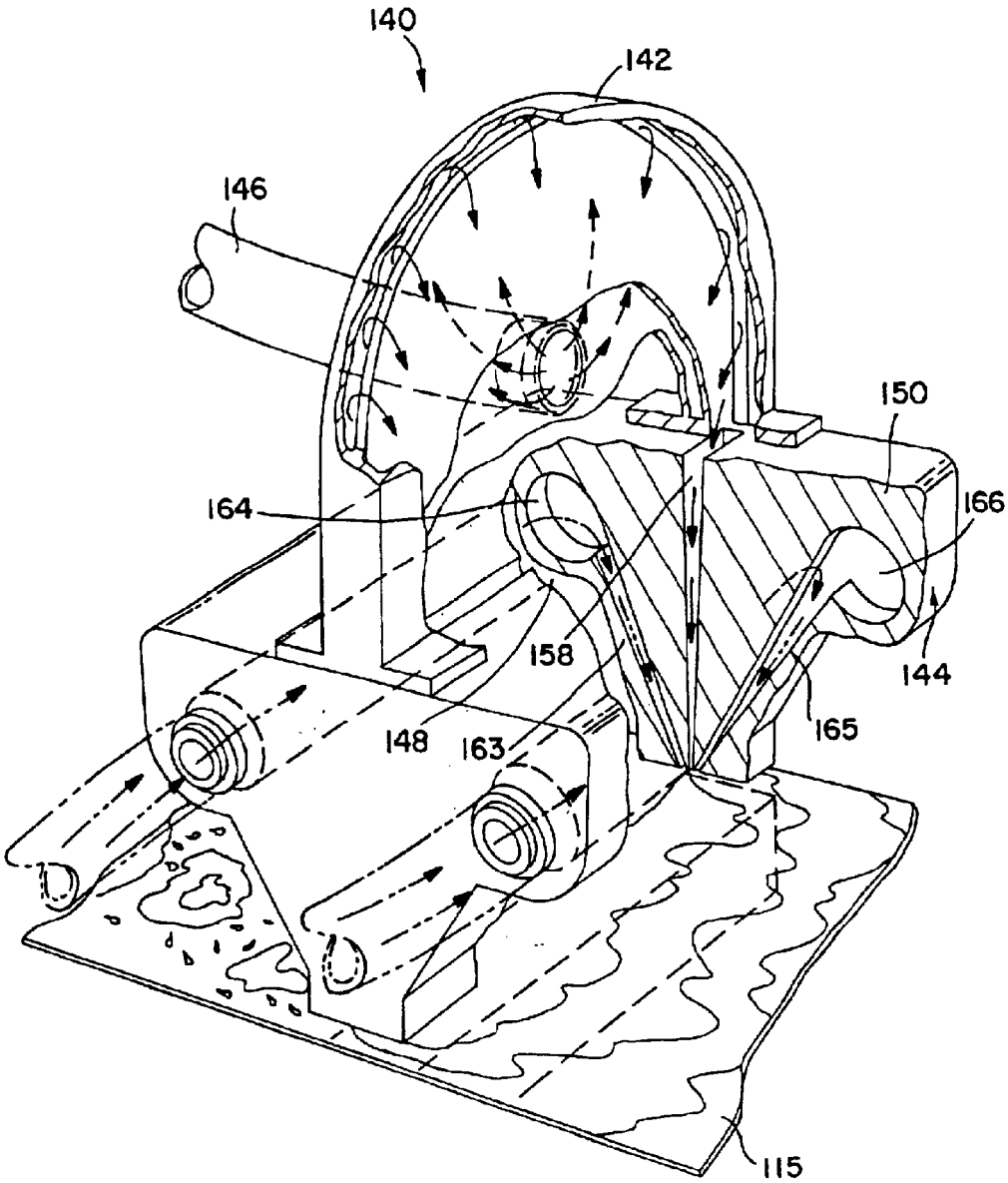
FIG. 4 is a perspective view of another embodiment of a foam applicator that may be used to apply foam to a paper web in the present invention.

In the embodiment discussed above, the impingement of the foam composition is accomplished internally within the foam applicator 40. In some instances, internal air stream impingement can provide a greater level of control because the range of angles, distances, etc., at which the foam composition and air stream may be placed into contact is larger. However, as indicated above, the foam composition may also be impinged with air externally to the foam applicator. Thus, for example, referring to FIGS. 4–5, one embodiment of a foam applicator 140 capable of externally contacting a foam composition with a stream of air is illustrated. The foam applicator 140 includes a distribution chamber 142, an extrusion head 144, a conduit 146, and nozzle bars 148 and 150, such as described above. The foam composition enters the extrusion head 144 via an extrusion channel 158 and traverses therethrough toward the wet paper web 115. In the illustrated embodiment, two air streams 164 and 166 converge toward the dispensing slot 152 at an angle, although any number of air streams may generally be utilized. The air streams 164 and 166 are provided by supply manifolds that supply the air for acceleration through air channels 163 and 165. Upon contact with the foam composition, the air streams 164 and 166 impinge the foam composition just after it exits the dispensing slot to fragment the gaseous bubbles.

Figure 3:
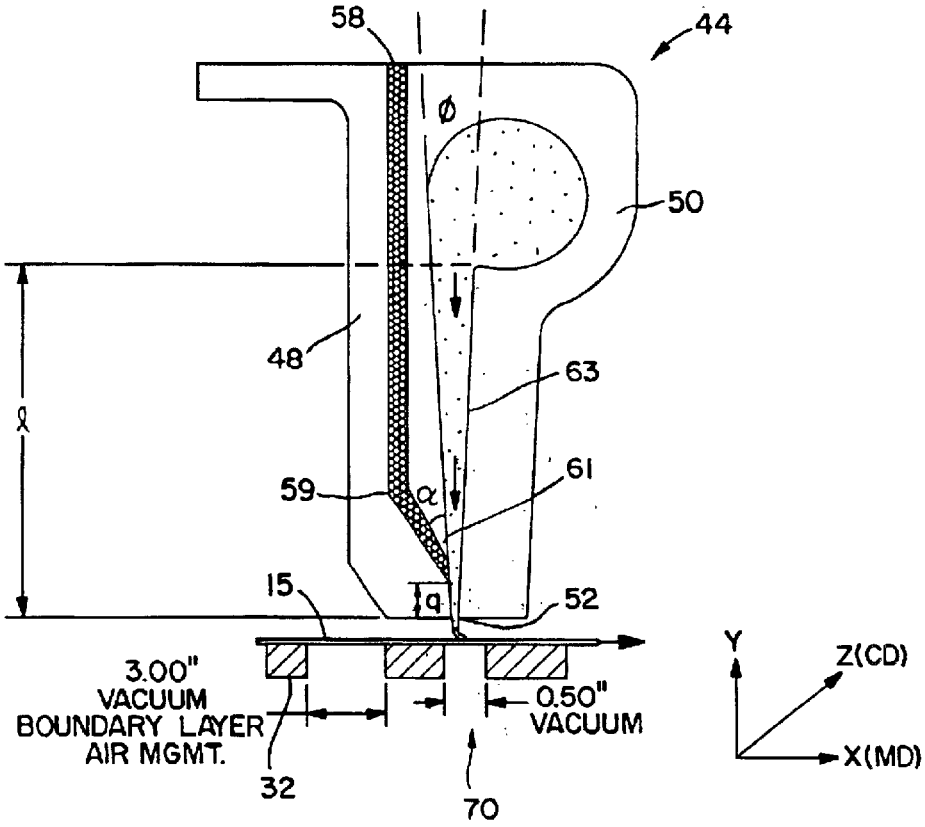
FIG. 3 is a cross-sectional view of the extrusion head of the foam applicator shown in FIG. 2.

The extent which the air stream 61, 164, and/or 166 fragment the gaseous bubbles of a foam composition can be readily controlled by varying certain geometric and/or process parameters of the foam applicator. For example, in some embodiments, the distance that at least one air stream is allowed to impinge the foam composition can be selectively varied to control the level of fragmentation of the gaseous bubbles. As shown in FIG. 3, the distance "a", which is defined as the distance from the initial convergence of the foam composition and at least one air stream to the dispensing slot, can be controlled. Larger distances result in a circumstance in which the foam is exposed to air at a lower velocity, but for a longer period of time. Smaller distances, on the other hand, result in a circumstance in which the foam is exposed to air at a higher velocity, but for a lesser period of time. For example, to achieve an optimum balance between air velocity and exposure time, the distance "a" may range from about 0.1 to about 12 inches, and in some embodiments, from about 0.2 to about 10 inches. For instance, when using an internal applicator system, the distance "a" may range from about 0.1 to about 6 inches, and in some embodiments, from about 0.2 to about 4 inches (e.g., 3 inches), and when using an external applicator system, may range from about 0.1 to about 1.5 inches, and in some embodiments, from about 0.5 to about 1.5 inches (e.g., 1.375 inches).

In addition, other geometric parameters may also be varied. For instance, in some embodiments, the angle of impingement a at which the foam composition converges with the air stream(s) can be varied to control the level of fragmentation of the gaseous bubbles. By increasing the angle of impingement, the air stream(s) can contact the foam composition at a greater momentum, thereby fragmenting a greater number of gaseous bubbles, but also disrupting the uniformity of the foam composition. The angle of impingement for multiple air streams may be the same or different. Thus, in some embodiments, the angle of impingement $\alpha$ for one or more air streams can range from about 5° to about 60°, in some embodiments from about 10° to about 40°, and in one particular embodiment, is about 20° for each air stream.

Further, various parameters may also be controlled to provide more uniformly converging air stream(s), and thus, enhance the uniformity of foam deposition. For instance, the angle of convergence $\phi$ of the air stream channel(s) can range from about 0.5° to about 10°, in some embodiments from about 1° to about 5°, and in some embodiments, from about 1° to about 3°. In addition, the ratio of the length of an air supply to the thickness of a corresponding air channel at the point where the air stream impinges the foam composition can also be varied to control the extent of fragmentation. For example, in some embodiments, this ratio can be at least about 20, in some embodiments at least about 30, and in some embodiments, at least about 40. Further, the ratio of the total area defined by an air supply to the area defined by the corresponding air channel at the point where the air stream impinges the foam composition can also be varied to control the extent of fragmentation. For example, in some embodiments, this ratio can be at least about 3, in some embodiments at least about 4, and in some embodiments, at least about 5.

Besides varying geometric parameters of the foam applicator, certain process parameters may also be varied. For instance, the pressure of the air stream(s) can be varied to control the overall velocity of the stream(s) at certain pressures, e.g., 0–13 psig. In particular, by increasing the pressure of the air stream(s), a greater amount of gaseous bubbles can be fragmented. For example, when utilizing a single air stream, the pressure of the air stream can sometimes range from about 3 inches of water to about 50 inches of water, in some embodiments from about 10 to about 25 inches of water, and in some embodiments, from about 18 inches of water to about 22 inches of water. Moreover, when utilizing multiple air streams, the pressure of each stream can sometimes range from about 5 to about 40 inches of water, and in some embodiments, from about 10 inches of water to about 20 inches of water.

Although various embodiments of internal and external impingement foam applicators have been described above, it should also be understood that any other configuration in which one or more air streams are allowed to impinge the foam composition can be used in the present invention. For instance, in one embodiment, the air channel 63 (FIG. 2) of the foam applicator 40 can bend at an angle toward the extrusion channel 58 so that the air stream 61 impinges a foam composition traversing through the extrusion channel 58 in a substantially lengthwise direction. Moreover, in another embodiment, the extrusion channel 158 of the foam applicator 140 (FIG. 4) can bend at an angle toward the air streams 164 and/or 166. As indicated above, it should be understood that more than one air stream and/or extrusion channel may also be utilized.

In accordance with the present invention, it has been discovered that by impinging the foam composition with an air stream, either internally or externally, gaseous bubbles contained therein can be fragmented such that the desired chemistry can be more uniformly distributed over the surface of the paper web from the extrusion head. The foam may be distributed into the lower points and/or the higher points of the surface of the moving paper web.

Referring again to FIGS. 1–5, a vacuum slot 70 may be positioned to extend across the width of the wet paper web 15 in the cross direction of the wet paper web 15 below the foam applicator 40 (or 140). It is understood that the vacuum slot 70 may be one continuous vacuum slot or made up of multiple vacuum slots positioned across the CD direction of the paper web 15. It is also understood that the length of the vacuum slot 70 in the CD direction may be less than, greater than, or equal to the CD width of the wet paper web 15. The vacuum slot 70, as discussed below regarding the boundary air layer vacuum slot 32, may generally be formed by a variety of devices that are capable of applying a negative pressure on the wet paper web 15, such as vacuum boxes, vacuum shoes, vacuum rolls, foils, or any other method known in the art. The vacuum slot 70 may have a slot opening width from about 1 inch and about ⅛ inch, more specifically a width from about ¾ inch and about ¼ inch, and most specifically a width from about ¾ inch and about ½ inch. For instance, in one embodiment, the vacuum slot 70 has a slot opening width of about ½ inch to about ¾ inch and operates at a vacuum pressure of from about 20 to about 25 inches of water.

Figure 5:
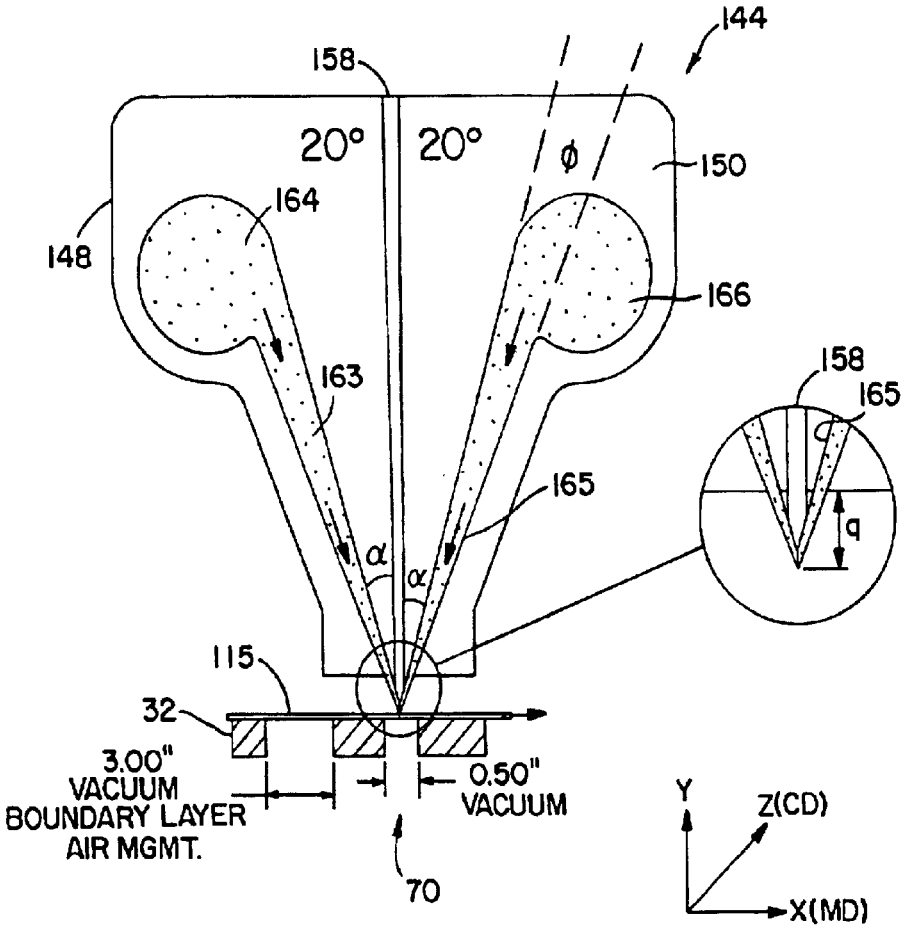
FIG. 5 is a cross-sectional view of the extrusion head of the foam applicator shown in FIG. 4.

Although not required, the vacuum slot 70 may aid in drawing the foam toward or into the wet paper web 15. For instance, once formed, the foam bubbles generally remain under pressure until the instant of application to the wet paper web 15 by the foam applicator 40 so that the liquid forming the bubbles may be blown onto the wet paper web 15 by airlet(s) and/or nozzle(s) of the foam applicator 40. As shown in FIGS. 3 and 5, the vacuum slot 70 may draw these foam bubbles towards the wet paper web 15, thereby facilitating the application of the foam onto or into the wet paper web 15. The vacuum slot 70 may also be utilized to reduce the boundary air layer surrounding the wet paper web 15. In addition, the vacuum slot 70 can assist with the deposition of the foam onto the wet paper web 15. The vacuum slot 70 can also aid in the removal of the air that is entrained within the foam. It should be understood that other vacuum slot(s) located in various positions may be utilized in the present invention. Moreover, it should also be understood that a vacuum slot is not required to apply foam to the paper web 15. For example, in some embodiments, the fabric may be substantially impermeable so that a vacuum slot is not desirable.

A boundary air layer vacuum slot 32 may also be utilized to reduce the "boundary air layer" surrounding the fabric 23. As used herein, a "boundary air layer" generally refers to a layer of air that is entrained by a moving fabric or paper web supported on a fabric. Boundary air layers may be present at any speed at which a tissue machine is operated, including speeds of about 1,000 feet per minute, about 2,000 feet per minute, and 3,000 feet per minute or greater. For example, boundary air layers often occur at high linear speeds, such as at speeds above about 4,000 feet per minute, and in some embodiments, from about 4,000 feet per minute to about 6,000 feet per minute. Boundary air layers may sometimes disrupt foam application. As such, it is typically desired to minimize the boundary air layer to enhance the efficiency of foam application. In one embodiment, for example, the boundary air layer vacuum slot 32 may be downstream from the foam applicator 40 to help minimize the boundary air layer.

The boundary air layer vacuum slot 32 may be positioned to extend across the width of the fabric 23. The length of the boundary air layer vacuum slot 32 can be from about 0.25 inches and about 6 inches, and in some embodiments, from about 1 inch to about 5 inches in the -x direction (machine direction). For instance, in one embodiment, the length of the boundary air layer vacuum slot 32 is about 3 inches and the vacuum pressure was approximately 1 psig or less.

The boundary air layer vacuum slot 32 may generally be formed by a variety of devices that are capable of applying a negative pressure on the wet paper web 15, such as vacuum boxes, vacuum shoes, vacuum rolls, foils, or any other method known in the art. Moreover, the boundary air layer vacuum slot 32 may have any desired size, dimension, and/or shape desired. For example, in some embodiments, the boundary air layer vacuum slot 32 may have a slot opening width from about 3 inches and about ⅛ inch, more specifically a width from about ¾ inch and about ¼ inch, and most specifically a width from about ¾ inch and about ½ inch. For instance, in one embodiment, the boundary air layer vacuum slot 32 has a slot opening width of about ½ inch. In another embodiment, the boundary air layer vacuum slot 32 has a slot opening width of about ¾ inch.

The boundary air layer vacuum slot 32 may be utilized to reduce the "boundary air layer" surrounding the wet paper web 15. As used herein, a "boundary air layer" generally refers to a layer of air that is entrained by a moving fabric or paper web supported on a fabric. Boundary air layers may be present at any speed at which a tissue machine is operated, including speeds of about 1,000 feet per minute, about 2,000 feet per minute, and 3,000 feet per minute or greater. For example, boundary air layers often occur at high linear speeds, such as at speeds above about 4,000 feet per minute, and in some embodiments, from about 4,000 feet per minute to about 6,000 feet per minute. Boundary air layers may sometimes disrupt foam application. As such, it is typically desired to minimize the boundary air layer to enhance the efficiency of foam application. In one embodiment, for example, the boundary air layer vacuum slot 32 may be upstream from the foam applicator 40 to help minimize the boundary air layer. Further, various other mechanisms may also be utilized to minimize the boundary air layer, such as using deflecting mechanisms. Moreover, it should be understood that it may not be necessary to reduce the boundary air layer in all circumstances when applying a foam to a wet paper web 15 in accordance with the present invention.

Any type of tissue construction can be applied with a foam composition in accordance with the present invention. For example, the tissue product can be a single-ply tissue product in which the paper web forming the tissue is has one layer or is stratified, i.e., has multiple layers, or a multi-ply tissue product in which the paper webs forming the multi-ply tissue product may themselves be either single or multi-layered. However, it should be understood that the tissue product can include any number of plies or layers and can be made from various types of fibers.

The material(s) used to make the paper web can include fibers formed by a variety of pulping processes, such as kraft pulp, sulfite pulp, thermomechanical pulp, etc. The pulp fibers may include softwood fibers having an average fiber length of greater than 1 mm and particularly from about 2 to 5 mm based on a length-weighted average. Such softwood fibers can include, but are not limited to, northern softwood, southern softwood, redwood, red cedar, hemlock, pine (e.g., southern pines), spruce (e.g., black spruce), combinations thereof, and the like. Exemplary commercially available pulp fibers suitable for the present invention include those available from Kimberly-Clark Corporation under the trade designations "Longlac-19".

Hardwood fibers, such as eucalyptus, maple, birch, aspen, and the like, can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste. Further, other natural fibers can also be used in the present invention, such as abaca, sabai grass, milkweed floss, pineapple leaf, and the like. In addition, in some instances, synthetic fibers can also be utilized. Some suitable synthetic fibers can include, but are not limited to, rayon fibers, ethylene vinyl alcohol copolymer fibers, polyolefin fibers, polyesters, and the like.

The paper web can generally be formed by any of a variety of papermaking processes known in the art. In particular, it should be understood that the present invention is not limited to any particular papermaking process. In fact, any process capable of producing a paper web can be utilized in the present invention. For example, a papermaking process of the present invention can utilize creping, embossing, wetpressing, through-drying, through-dry creping, uncreped through-drying, double creping, calendering, as well as other steps and/or papermaking devices (e.g., Yankee dryers) in producing the paper web.

In one particular embodiment, the paper web is formed by a technique known as "uncreped through-drying." Uncreped through-drying generally involves the steps of: (1) forming a furnish of cellulosic fibers, water, and optionally, other additives; (2) depositing the furnish on a moving papermaking surface (e.g., belt, fabric, wire, etc.), thereby forming a paper web on top of the moving papermaking surface; (3) subjecting the paper web to through-drying to remove the water from the paper web; and (4) removing the dried paper web from the moving papermaking surface. Examples of such a technique are disclosed in U.S. Pat. No. 5,048,589 issued to Cook, et al.; U.S. Pat. No. 5,399,412 issued to Sudall, et al.; U.S. Pat. No. 5,510,001 issued to Hermans, et al.; U.S. Pat. No. 5,591,309 issued to Rugowski, et al.; and, U.S. Pat. No. 6,017,417 issued to Wendt, et al., which are incorporated herein in their entirety by reference thereto for all purposes. The U.S. Pat. No. 6,017,417 is hereinafter referred to at the "Wendt et al. reference".

In this regard, one embodiment of an uncreped through-drying papermaking process that can be used in the present invention is illustrated in FIG. 1. The process includes some optional locations for one or more foam applicators 40, examples of which are illustrated in FIG. 1 as 30, 36, 38, 84, 90, 92, and 94. It is understood that other locations may be used for foam application in accordance with the present invention as well. For simplicity, the various tensioning rolls schematically used to define the several fabric runs are shown but not numbered.

As shown, a papermaking headbox 10 is used to inject or deposit a stream 11 of an aqueous suspension of fibers onto the forming fabric 12. The headbox 10 may be any papermaking headbox used in the art, such as a stratified headbox capable of producing a multilayered paper web. For example, it may be desirable to provide relatively short or straight fibers in one layer of the paper web to give a layer with high capillary pressure, while another layer contains relatively longer, bulkier, or more curled fibers for high permeability and high absorbent capacity and high pore volume. It may also be desirable to apply different chemical agents to separate layers of the paper web to optimize dry and wet strength, pore space, wetting angle, appearance, or other properties of a paper web. Further, multiple headboxes may be used to create a layered structure, as is known in the art.

With the aid of a roll 14, the stream 11 is then transferred from the forming fabric 12 to a drainage fabric 13, which serves to support and carry the newly-formed wet paper web 15 downstream in the process as the wet paper web 15 is partially dewatered to a solids consistency of about 10% by dry weight of the wet paper web 15. In some instances, additional dewatering of the wet paper web 15 may be carried out, such as by a vacuum slot 70, while the wet paper web 15 is supported by the drainage fabric 13.

In accordance with one embodiment of the present invention, a foam applicator 40 (or 140) may be optionally positioned at a location 30 to supply foam to the wet paper web 15 as it is carried on the drainage fabric 13. For example, in some embodiments, the foam applicator 40 may be positioned less than about 2 inches from the surface of the wet paper web 15, and in some embodiments, less than about 1 inch from the wet paper web 15. In this embodiment, the consistency of the wet paper web 15 being applied with foam is typically from about 10% to about 35%, and in some embodiments, from about 15% to about 30%. Due to the relatively high moisture content of the wet paper web 15, the foam applicator 40 may be configured to apply the foam in a manner such that it tends to migrate through the entire wet paper web 15. However, it should also be understood that the foam applicator 40 may also be configured to apply the foam primarily onto the surface of the wet paper web 15.

In some embodiments, a vacuum slot 70, such as described above, may also be utilized in conjunction with the foam applicator 40 to aid in applying foam to the wet paper web 15. Although not required, the vacuum slot 70 may aid in drawing the foam towards or into the wet paper web 15.

Referring again to FIG. 1, the wet paper web 15 is then transferred from the drainage fabric 13 to a transfer fabric 17 that may travel at a slower speed than the drainage fabric 13 in order to impart increased stretch into the wet paper web 15. This is commonly referred to as "rush" transfer. One useful method of performing rush transfer is taught in U.S. Pat. No. 5,667,636 issued to Engel et al., which is incorporated herein in its entirety by reference thereto for all purposes. The relative speed difference between the drainage fabric 13 and the transfer fabric 17 may be from 0% to about 80%, in some embodiments from about 10% to about 60%, and in some embodiments, from about 10% to about 40%. The transfer may be carried out with the assistance of a vacuum shoe or roll such that the drainage fabric 13 and the transfer fabric 17 simultaneously converge and diverge at the leading edge of the vacuum slot of the vacuum shoe or roll.

Thereafter, the wet paper web 15 is transferred from the transfer fabric 17 to a through-drying fabric 19 with the aid of a vacuum transfer roll or shoe. The through-drying fabric 19 may be traveling at about the same speed or a different speed relative to the transfer fabric 17. For example, if desired, the through-drying fabric 19 may run at a slower speed to further enhance stretch. The vacuum transfer roll or shoe (negative pressure) may be supplemented or replaced by the use of positive pressure from the opposite side of the wet paper web 15 to blow the wet paper web 15 onto the next fabric.

In some embodiments, the through-drying fabric 19 may be a smoother fabric, such as Asten 934, 937, 939, 959 or Albany 94M. However, in other embodiments, it may be desired to form elevated regions and depressions into the wet paper web 15. To impart such elevated regions, in one embodiment, the through-drying fabric 19 may be a fabric having impression knuckles, such as described in the Wendt et al. reference. For example, when imprinted with elevations, the resulting paper web can have from about 5 to about 300 protrusions per square inch. Moreover, the protrusions can have a height relative to the plane of the basesheet, as measured in the uncalendered state and uncreped state, of greater than about 0.1 mm, particularly greater than about 0.2 mm, more particularly greater than about 0.3 mm, and in most embodiments, from about 0.25 mm to about 0.6 mm.

Thereafter, a through-dryer 21 may accomplish the removal of moisture from the wet paper web 15 by passing air through the wet paper web 15 without applying any mechanical pressure. The through-drying process may also increase the bulk and softness of the wet paper web 15. In one embodiment, for example, the through-dryer 21 may contain a rotatable, perforated cylinder and a hood (not shown) for receiving hot air blown through perforations of the cylinder as through-drying fabric 19 carries the wet paper web 15 over the upper portion of the cylinder. The heated air is forced through the perforations in the cylinder of the through-dryer 21 and removes the remaining water from the wet paper web 15. The temperature of the air forced through the wet paper web 15 by the through-dryer 21 may vary, but is typically from about 300° F. to about 400° F.

While supported by the through-drying fabric 19, the wet paper web 15 may then be partially dried by the through-dryer 21, such as, for example, to a solids consistency of less than about 95% by dry weight of the wet paper web 15, in some embodiments to a solids consistency of from about 60% to about 95% by dry weight of the wet paper web 15, and in some embodiments, to a solids consistency of from about 80% to about 90% by dry weight of the wet paper web 15.

In accordance with one embodiment of the present invention, a foam applicator 40 (or 140) may optionally be positioned at or near the nip 35 formed by the through-drying fabric 19 and a fabric 23. For example, in some embodiments, the foam applicator 40 may be positioned less than about 100 inches from the nip 35, and in some embodiments, from about 5 to about 60 inches from the nip 35. In this embodiment, the solids consistency of the wet paper web 15 being applied with foam can be greater than about 50%, and in some embodiments from about 60% to about 95%, and in some embodiments, from about 80% to about 90% by dry weight of the wet paper web 15. Due to the relatively high moisture content of the wet paper web 15, the foam applicator 40 may be configured to apply the foam in a manner such that it tends to migrate through the entire wet paper web 15. However, it should also be understood that the foam applicator 40 may also be configured to apply the foam primarily onto the surface of the wet paper web 15.

In some instances, applying foam at a nip formed between two or more moving papermaking surfaces, such as the nip 35 formed between the through-drying fabric 19 and the fabric 23, may facilitate the application of foam to the wet paper web 15. In particular, when two moving surfaces form a nip, such as the nip 35 shown in FIG. 1, the motion of the boundary air layers above each surface can facilitate foam application. Thus, by locating a foam applicator 40 near this area of suction, foam dispensed by the applicator 40 is naturally drawn to the nip 35 and onto the wet paper web 15 passing therethrough. As such, in accordance with the present invention, foam applicators may optionally be located at or near any nip formed by two or more moving papermaking surfaces to facilitate foam application.

Moreover, to further aid in the application of foam to the wet paper web 15, a vacuum slot 70, such as described above, may also be utilized. Besides being used to aid in foam application, vacuum slots may also be used to partially dewater the wet paper web 15, to reduce the boundary air layer, etc.

After being dried by the through-dryer 21 and optionally applied with foam at the nip 35, the wet paper web 15 is then sandwiched between the through-drying fabric 19 and the fabric 23 to further dewater the wet paper web 15. In some instances, another through-dryer 25 may substantially dry the wet paper web 15 by passing air therethrough without applying any mechanical pressure. For example, in some embodiments, the wet paper web 15 may be dried to a consistency of about 95% or greater by the through-dryer 21, thereby forming a dried paper web 16. The dried paper web 16 may be carried on additional fabrics, such as transfer fabrics 86 and 88 as shown in FIG. 1.

If desired, foam may also be applied to the dried paper web 16 at the location 90, at location 92, or at the location 94. The dried paper web 16 may then be transferred to a winding reel 96, or to various off-line processing stations, such as subsequent off-line calendering to improve the smoothness and softness of the dried paper web 16. In some instances, the foam is additionally applied to a dried or over-dried paper web 16 having a solids consistency equal to or greater than about 95%, more specifically equal to or greater than about 96%, more specifically equal to or greater than about 97%, more specifically equal to or greater than 98%, and more specifically equal to or greater than about 99%.

In some embodiments of the present invention, the speed of the wet paper web 15 and the dried paper web 16 may be established such that the composition so applied does not dry or set before the dried paper web 16 is wound on a parent roll or any other roll. The composition may then be partially transferred to the untreated surface of the dried paper web 16. A nip may be positioned to assist such a transfer.

Figure 6:
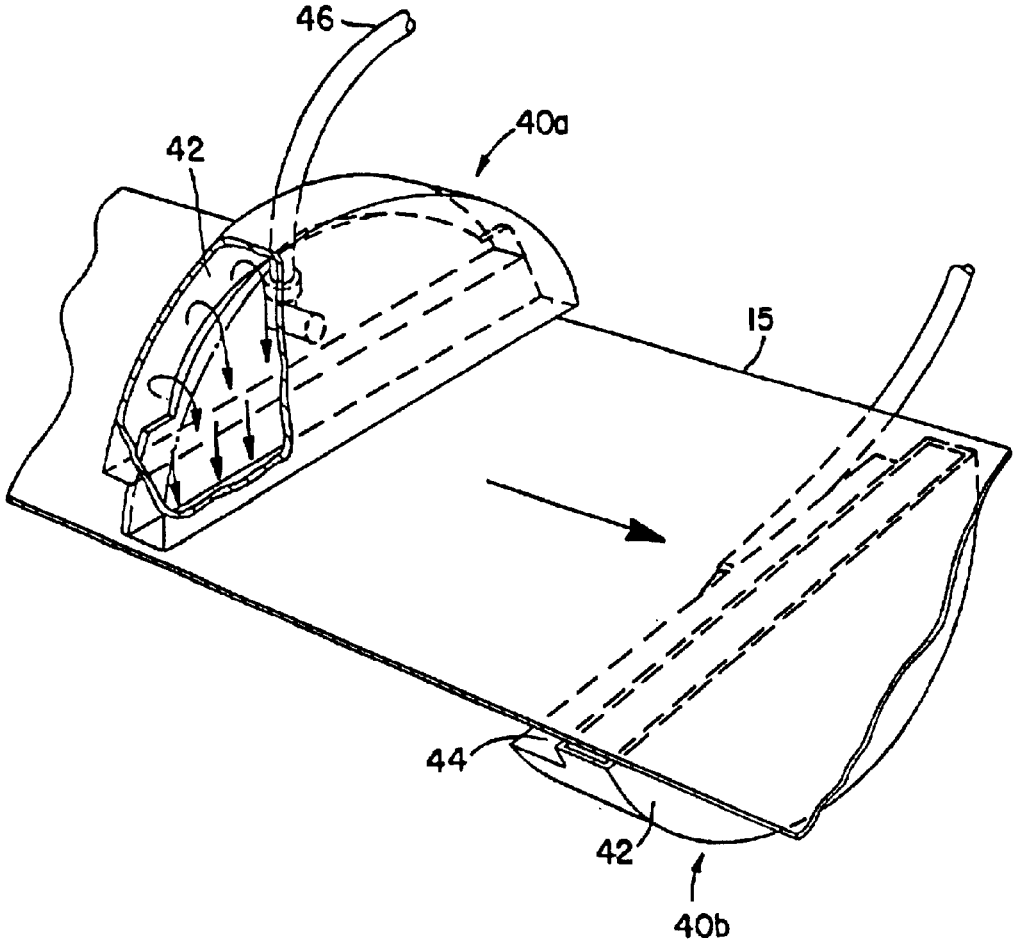
FIG. 6 is a perspective view of one embodiment of top and bottom foam applicators used to foam a composition onto a paper web in accordance with the present invention.

Although the use of only one foam applicator 40 and/or 140 is described in detail herein, it should be understood that any number of foam applicators may be used. For instance, as shown in FIG. 6, a first foam applicator 40*a* is shown as depositing a foam composition onto the top surface of the wet paper web 15, while a second applicator 40*b* is shown as depositing a foam composition on the bottom surface of the wet paper web 15. The second foam applicator 40*b* may be the same or different than the first foam applicator 40*a*. Moreover, although not required, it is typically desired that the first and second foam applicators 40*a* and 40*b* be positioned in a staggered configuration so that the wet paper web 15 can be better deflected around the first and second foam applicators 40*a* and 40*b*. It should also be understood that additional foam applicators 40 may be utilized in conjunction with the first and second applicators 40*a* and

40*b* to deposit foam compositions onto the top and/or bottom surfaces of the wet paper web 15.

In other embodiments of the present invention, both surfaces of the wet paper web 15 may be treated with the composition using the apparatus as disclosed herein. Both surfaces of the wet paper web 15 may be treated at substantially the same time or one surface of the wet paper web 15 may be treated with the composition and then the other surface of the wet paper web 15 subsequently treated with the composition. In other embodiments of the present invention, one surface of the wet paper web 15 is treated with one composition and the other surface of the wet paper web 15 is treated with another composition.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method of applying a foam composition having gaseous bubbles to a paper web having a first surface and an opposing second surface, said method comprising:

positioning a foam applicator adjacent to said first surface of said web, said foam applicator defining an extrusion channel through which the foam composition is capable of flowing, said foam applicator further defining a dispensing slot through which the foam composition is capable of exiting said foam applicator;

flowing the foam composition through said extrusion channel of said foam applicator; and fragmenting said gaseous bubbles in said foam composition with at least one gaseous stream before said foam composition is applied to said first surface of said paper web.

2. A method as defined in claim 1, wherein said foam applicator further defines a gaseous channel through which said gaseous stream flows.

3. A method as defined in claim 2, wherein said gaseous stream is accelerated through said gaseous channel.

4. A method as defined in claim 1, wherein the gaseous bubbles in the foam composition are fragmented with said gaseous stream before exiting said dispensing slot.

5. A method as defined in claim 1, wherein the gaseous bubbles in the foam composition are fragmented with said gaseous stream after exiting said dispensing slot.

6. A method as defined in claim 1, wherein the foam composition is impinged with multiple gaseous streams.

7. A method as defined in claim 1, wherein the distance from the initial convergence of said gaseous stream to said dispensing slot is from about 0.1 to about 12 inches.

8. A method as defined in claim 1, wherein the angle at which said gaseous stream impinges the foam composition is from about 10° to about 40°.

9. A method as defined in claim 1, wherein said foam applicator contains a first nozzle bar and a second nozzle bar, said first and second nozzle bars defining said extrusion channel.

10. A method as defined in claim 1, wherein the pressure of said gaseous stream is from about 3 to about 50 inches of water.

11. A method as defined in claim 1, wherein the pressure of said gaseous stream is from about 10 to about 25 inches of water.

12. A method as defined in claim 1, further comprising positioning a vacuum slot adjacent to said second surface of said paper web so that the paper web is positioned between said foam applicator and said vacuum slot.

13. A method as defined in claim 1, wherein said foam applicator is positioned less than about 2 inches from said first surface of said paper web.

14. A method as defined in claim 1, wherein said foam applicator is positioned from about 1 inch to about 2 inches from said first surface of said paper web.

15. A method as defined in claim 1, wherein the paper web is a wet paper web.

16. A method as defined in claim 1, wherein said paper web is a dried paper web.

17. A method of applying a foam composition to a paper web having a first surface and an opposing second surface, said method comprising:

positioning a foam applicator adjacent to said first surface of said web, said foam applicator defining an extrusion channel through which the foam composition is capable of flowing, said foam applicator further defining a dispensing slot through which the foam composition is capable of exiting said foam applicator;

flowing the foam composition through said extrusion channel of said foam applicator; and impinging said foam composition with at least one gaseous stream before said foam composition exits said dispensing slot.

18. A method as defined in claim 17, wherein the foam composition is impinged with multiple gaseous streams.

19. A method as defined in claim 17, wherein the distance from the initial convergence of said gaseous stream to said dispensing slot is from about 0.1 to about 12 inches.

20. A method as defined in claim 17, further comprising positioning a vacuum slot adjacent to said second surface of said paper web so that the paper web is positioned between said foam applicator and said vacuum slot.

* * * * *